United States Patent [19]

Cole

[11] 4,064,947

[45] Dec. 27, 1977

[54] DRAW BAR FOR A MOTOR GRADER

[75] Inventor: Carroll Richard Cole, Decatur, Ill.

[73] Assignee: Caterpillar Tractor Co., Peoria, Ill.

[21] Appl. No.: 661,880

[22] Filed: Feb. 27, 1976

[51] Int. Cl.[2] ..... E02F 3/76

[52] U.S. Cl. ..... 172/781; 52/731

[58] Field of Search ..... 172/776, 780, 781, 782, 172/783, 784, 785, 786, 787, 788, 789, 790, 791, 792, 793, 794, 795, 796, 797, 798, 799; 52/729, 731; 280/511; 246/28 R, 31 R

[56] References Cited

U.S. PATENT DOCUMENTS

| | | | |
|---|---|---|---|
| 1,320,072 | 10/1919 | Long | 52/729 |
| 2,128,881 | 8/1938 | Iverson | 172/797 |
| 2,497,778 | 2/1950 | Lado | 172/797 |
| 2,498,044 | 2/1950 | Le Tourneau | 172/793 |
| 2,646,633 | 7/1953 | Jahn | 172/782 |
| 3,101,819 | 8/1963 | Shinn | 52/731 |
| 3,421,589 | 1/1969 | Rivinius | 172/793 X |
| 3,470,967 | 10/1969 | Page et al. | 172/793 |
| 3,548,955 | 12/1970 | Hart | 172/793 |
| 3,694,990 | 10/1972 | Pamer | 52/731 |
| 3,722,864 | 3/1973 | Borer et al. | 52/731 X |

*Primary Examiner*—Richard T. Stouffer

*Attorney, Agent, or Firm*—Wegner, Stellman, McCord, Wiles & Wood

[57] ABSTRACT

Motor graders have a longitudinal main frame which carries a circle mounting bar that pivots on a horizontal axis at a connecting end and that has a carrying portion remote from its connecting end. A circle rotates on a vertical axis on the mounting bar carrying portion, and a grader blade is mounted on the circle. The present improved circle mounting bar is a box-like beam with internal vertical webs, and the beam increases in width from its connecting end toward a carrying portion of box-like cross section which is a separate part integrally welded to the beam. The shape of the beam in plan is intermediate between an isosceles triangle with its apex at the connecting end and a parabola with its apex at said end so as to give optimum uniformity of stress, throughout the length of the mounting bar, to both vertical and lateral forces.

20 Claims, 7 Drawing Figures

Fig-1-
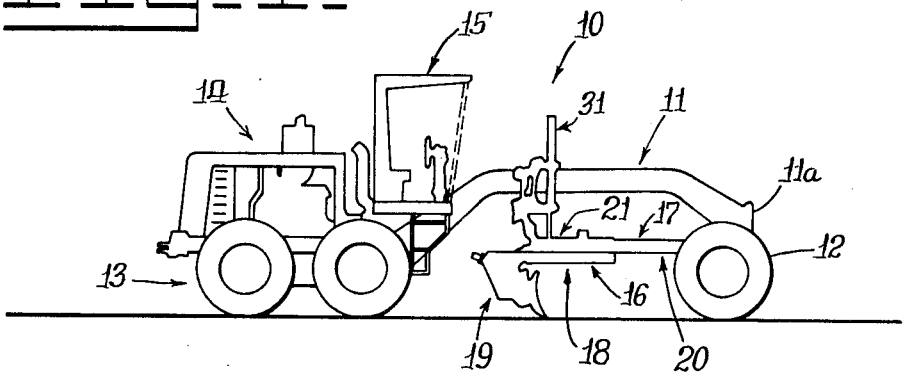
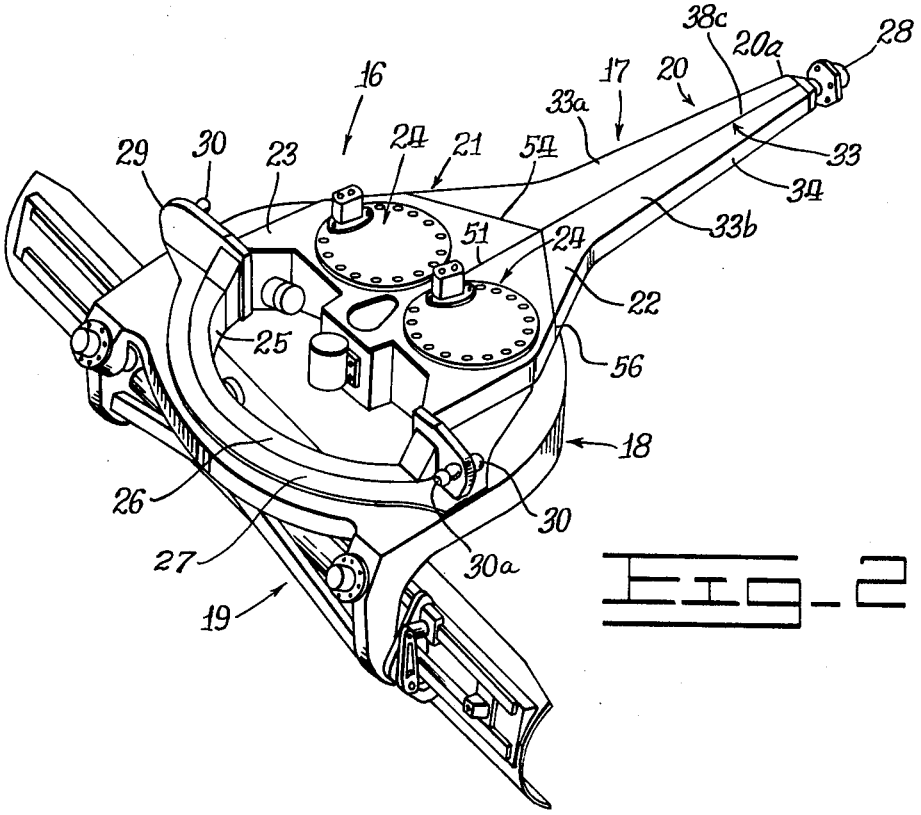
Fig-2-

DRAW BAR FOR A MOTOR GRADER

CROSS-REFERENCE TO RELATED APPLICATION

The circle mounting and circle assembly, and the mounting of the circle drive means, which are shown and described generally in this application, are described in detail and claimed in applicant's copending U.S. Pat. application Ser. No. 663,594, filed Mar. 3, 1976, now U.S. Pat. No. 4,015,669.

BACKGROUND OF THE INVENTION

Motor graders have a longitudinal main frame which has a dirigible wheel assembly at its forward end, an operator's cab at its rearward end portion, and a traction chassis for the motor and power train behind the cab. The motor grader blade is suspended from the main frame by means of a circle draw bar and a circle. The circle draw bar has its front end connected to the front of the main frame by a ball and socket connection, while the rearward portion of the circle draw bar is suspended from the main frame by hydraulic cylinder and piston means which permit the draw bar to swing in a vertical plane about its front end.

The circle is munted on the rearward portion of the circle draw bar for rotation about a vertical axis, and there is a driving interconnection between a motor on the circle draw bar and a ring gear on the circle to effect such rotary motion of the circle.

The grader blade is mounted upon the circle so that rotation of the circle changes the angle of the blade with reference to the path of travel of the grader, while swinging the circle draw bar in a vertical plane about its forward end changes the vertical position of the grader blade with reference to the ground.

In addition, the grader blade is mounted on a horizontal axis so that it may be tipped with respect to the circle by hydraulic cylinder and piston means to change the angle of attack of the blade.

Different types of circle draw bar and circle structures are illustrated in U.S. Pat. Nos. 2,497,778, 3,421,589, and 3,470,967. A type of grader structure in which the grader is towed behind a tractor instead of being at the front of a long grader vehicle, but which has a similar grader blade mounting, is illustrated in U.S. Pat. No. 2,498,044.

Typical grading operations place enormous stresses upon the circle draw bar, the circle and related parts of a motor grader. In operation the grader blade produces both vertical and lateral stresses in the entire system, and the direction and magnitude of those stresses varies depending upon the particular type of work being performed. Accordingly, it is difficult to engineer a grader blade mounting system which has adequate stress resistance without using excessively heavy components that increase grader cost and energy requirements.

SUMMARY OF THE INVENTION

The principal object of the present invention is to provide an improved circle draw bar for a motor grader blade support system.

Another object of the invention is to provide an improved motor grader circle draw bar which achieves a high degree of uniformity of stress through the length of the draw bar, both relative to vertical forces and to lateral forces.

Yet another object of the invention is to provide a motor grader circle draw bar which combines increased strength with relatively light weight.

Still another object of the invention is to provide a circle draw bar which consists of a box-like beam and an enlarged carrying portion of box-like cross section which is separately fabricated and then integrally welded to the beam so as to simplify necessary machining of the carrying portion which can be carried out before the carrying portion is welded to the beam.

The invention is disclosed as applied to a motor grader of the general type seen in U.S. Pat. No. 3,470,967, which is owned by applicant's assignee. However, it is apparent that the improved circle draw bar structure would also offer enhanced performance in a grader of the type disclosed in U.S. Pat. No. 2,498,044.

THE DRAWINGS

FIG. 1 is a side elevational view of a motor grader embodying the invention;

FIG. 2 is a perspective view of a sub-assembly consisting of a circle draw bar, a circle, and a grader blade in which the circle draw bar embodies the present invention;

DETAILED DESCRIPTION OF THE INVENTION

Figures 3, 4, 7:
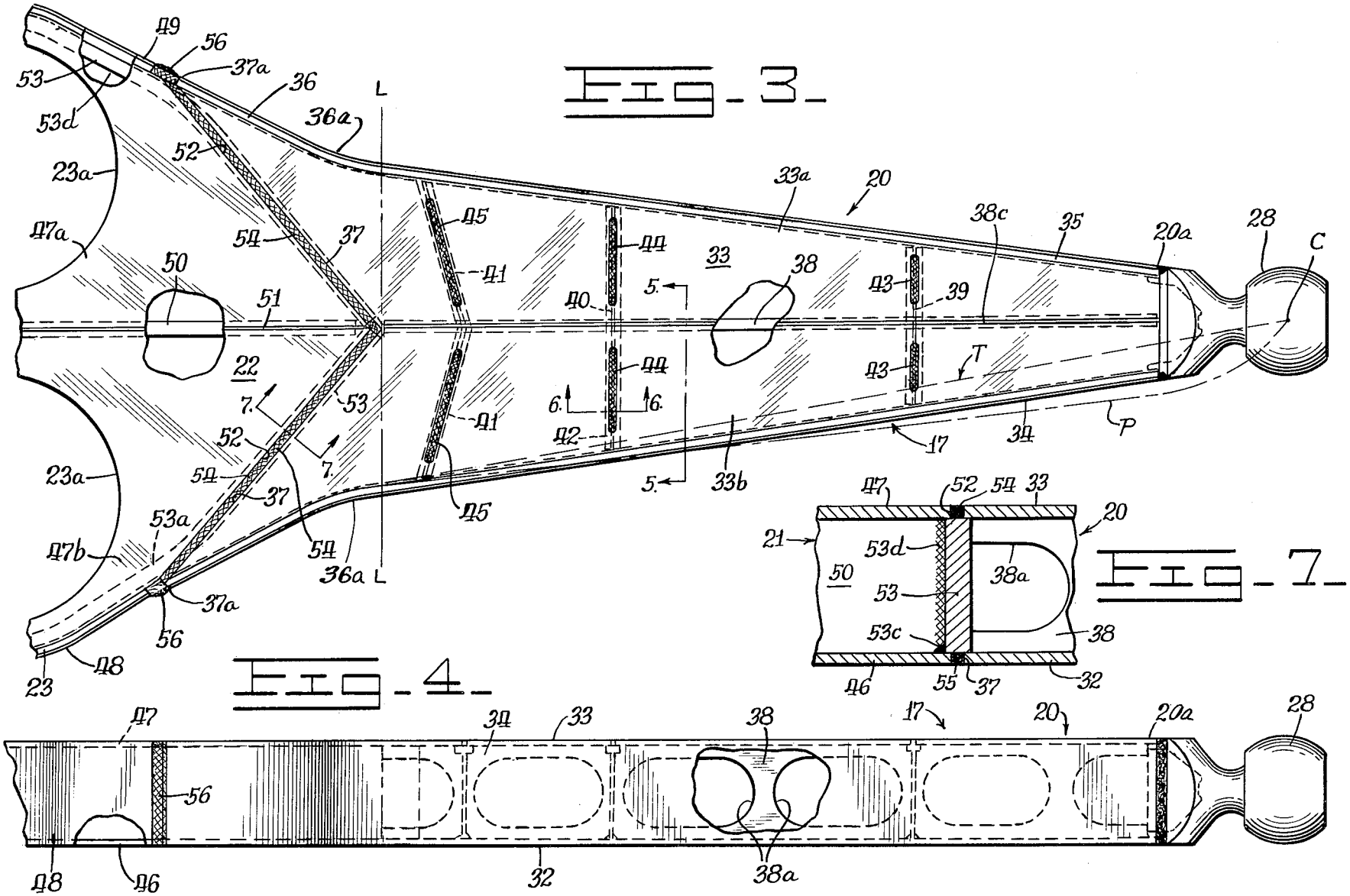
FIG. 3 is a fragmentary plan view illustrating the beam of a circle draw bar embodying the invention, and illustrating the adjacent forward part of the draw bar carrying portion, with parts broken away from clarity.
FIG. 4 is a fragmentary side elevational view of the circle draw bar with a part of the near side wall broken away to show internal construction.
FIG. 7 is a fragmentary sectional view taken substantially as indicated along the line 7—7 of FIG. 3.

Referring first to FIG. 1 of the drawings, a motor grader, indicated generally at 10, includes a longitudinal main frame 11 the front end **11*a* of which is supported upon a dirigible front wheel assembly 12, and the rear end of which constitutes part of a traction chassis, indicated generally at 13, on which is mounted a power plant, indicated generally at 14. An operator's cab, indicated generally at 15, is on the rear portion of the main frame, forward of the traction chassis. A grader blade subassembly, indicated generally at 16, consists generally of a circle mounting bar, indicated generally at 17, which in the illustrated apparatus is a draw bar; a circle structure, indicated generally at 18; and a grader blade and blade mounting, indicated generally at 19**.

The circle draw bar 17 is best seen in FIG. 2 to include a forward portion in the form of a box-like beam, indicated generally at 20, and a rearward carrying portion, indicated generally at 21, the forward part 22 of which is also generally box-like to match the rear end of the beam 20. Behind the box-like part 22 of the carrying portion 21 said carrying portion has a section 23 the depth of which is great enough that it forms a housing extending below the circle 18. The housing section 23 contains cavities **23*a* (FIG. 3) to receive drive means, indicated generally at 24**, which operate through an internal ring gear (not shown) that is integral with the circle 18 for rotating the circle about a vertical axis. The housing section 23 of the circle draw bar merges into a nearly semi-annular upright wall 25 which is part of an internal housing for the circle 18, and integral with the wall 25 is a horizontal top wall 26. An integral flange member 27 overlies the more inward portion of the circle. Removable means (not shown) underlies the housing section 23 and the flange member 27 to support the circle structure 18.

The subassembly 16 is mounted under the main frame 11 by means of a front mounting element and rear mounting elements which engage with cooperating elements carried upon the main frame. At the front end 20*a* of the circle draw bar is a ball 28 which forms part of a ball and socket connection (not shown) by means of which the front of the circle draw bar is connected for universal movement on the front end 11*a* of the main frame. At the back end of the housing section 23 of the rearward circle draw bar portion 21 is a pair of aligned, laterally extending upright plates 29 which are provided with balls 30 that make ball and socket connections with fittings (not shown) on the lower ends of a pair of hydraulic cylinder and piston untis 31 which are carried upon the main frame 11. Thus, operation of the hydraulic cylinder units 31 swings the circle draw bar 17 about the ball and socket connection including the ball 28, which in this respect provides a horizontal pivot axis. A ball 30*a* on one of the webs 29 provides for a ball and socket connection with a side-shift cylinder (now shown) which shifts the draw bar sideways, with the ball 28 providing a vertical pivot axis.

Referring now particularly to FIGS. 3 to 6, the beam 20 is seen to consist of a one-piece bottom wall 32, a top wall 33 formed from two plates 33*a* and 33*b*, and side walls 34 and 35 which give it a box-like configuration; and the width of the beam increases uniformly from its front, or connecting end 20*a* to a transverse plane L—L which is close to the forward extremity of the carrying portion 21 of the circle draw bar. To the rear of the plane L—L the width of the beam 20 increases at a more rapid rate providing a flared beam rear portion 36.

The sides 36*a* of the flared beam rear portion 36 are gently curved, avoiding any sharp "break" in the contour which tends to produce early fatigue failure in this area of the structure which is subjected to very heavy stress in use. From the vicinity of the plane L—L at a line on the longitudinal, vertical median plane of the beam the rear edges of the bottom and top walls 32 and 33 extend diagonally outwardly and rearwardly as seen at 37 in FIG. 3 to the extremities where they join the side walls 34 and 35 at the rear of the flared portion 36. Thus, the rear end of the beam 20 has a shallow V conformity. The longitudinal edges of the bottom wall 32 and the side edges of the top wall plates 33*a* and 33*b* are joined to the side walls 34 and 35 by plug welds such as the welds 32*a* and 33*c* seen in FIG. 5.

Figure 5:
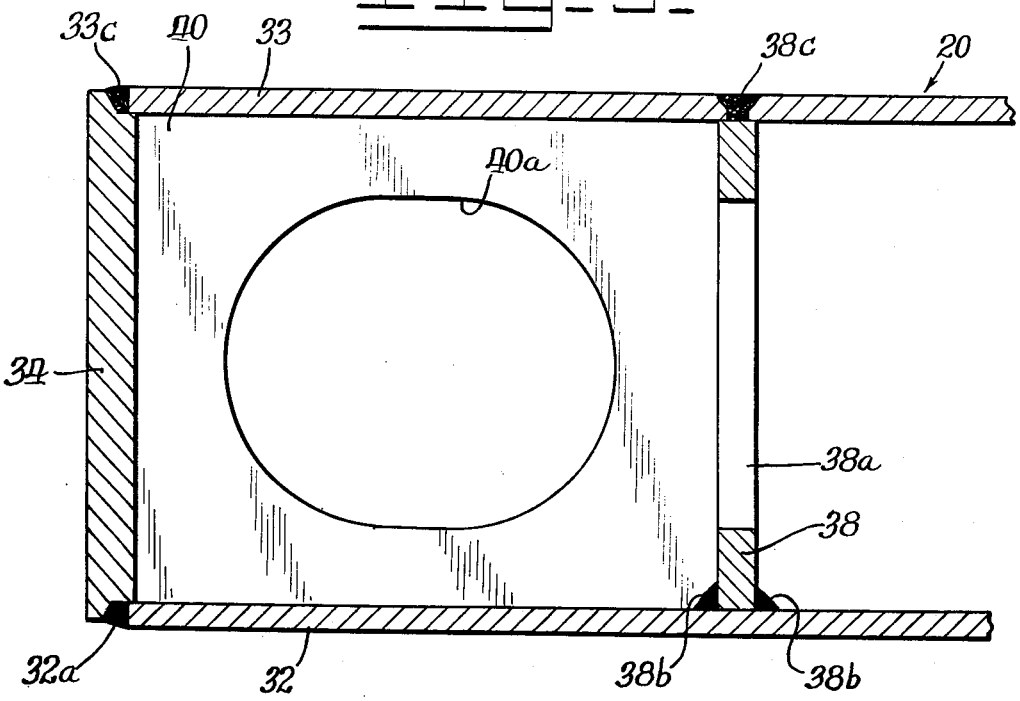
FIG. 5 is a fragmentary sectional view on an enlarged scale taken substantially as indicated along the line 5—5 of FIG. 3.
Figure 6:
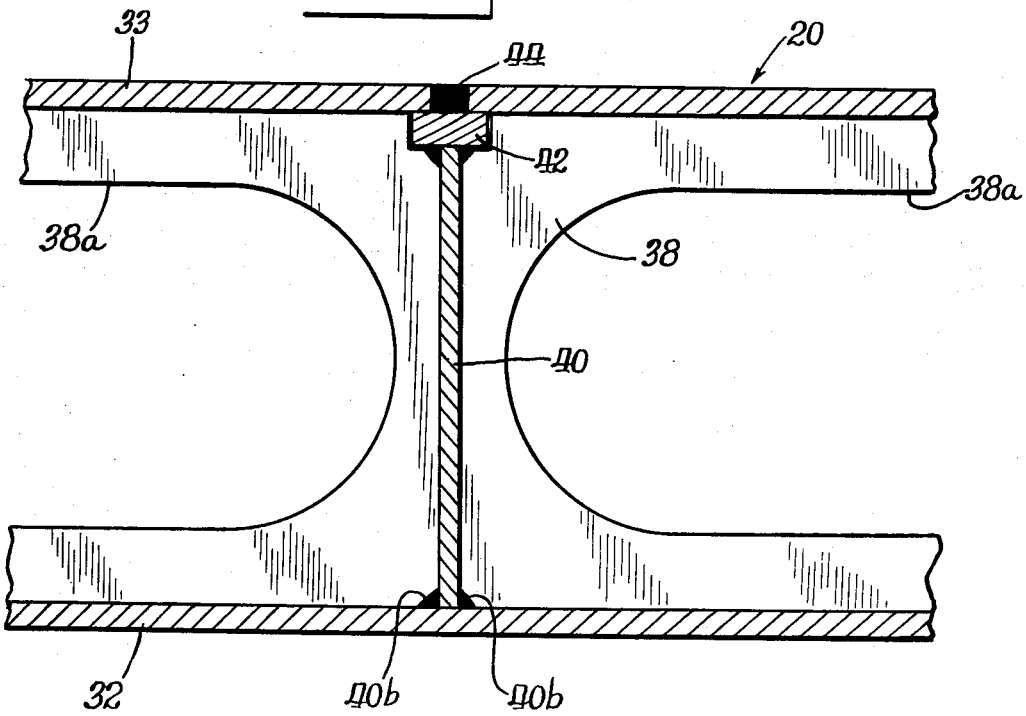
FIG. 6 is a fragmentary sectional view on an enlarged scale taken substantially as indicated along the line 6—6 of FIG. 3.

The beam 20 also has a vertical web 38 on its longitudinal median plane and transverse webs 39 and 40 which are in planes normal to the longitudinal web 38 and which are alike except for their lengths. As seen in FIGS. 5 and 6, all of said webs are connected to the one-piece bottom plate 32 by welds such as 38*b* and 40*b*.

Just forward of the plane L—L is a transverse web 41 which consists of two plates which extend diagonally rearwardly from the plate 38 to the sides 34 and 35 of the beam, with the lateral extremities of the web 41 being slightly forward of said plane L—L. Said plates are also joined to the bottom plate by welds.

All of the webs 38, 39, 40 and 41 are provided with elongate openings, such as the openings 38*a* and 40*a* seen in FIGS. 4, 5 and 6, in order that said webs may be of minimum weight consistent with requisite structural strength. Furthermore, the transverse webs 39, 40 and 41 have their upper ends welded to transverse bars such as the bar 42 seen in FIG. 6, for a strong connection between the transverse webs and the top wall. The web 38 is notched to receive the bar 42.

The top wall plates 33*a* and 33*b* have adjacent margins which are seen in FIG. 5 to overlap the longitudinal web 38 so that a weld 38*c* may join the plates 33*a* and 33*b* to each other and to the longitudinal web. The top wall plates 33*a* and 33*b* have elongate openings in register with the bars 42 that form the upper ends of the transverse webs 39, 40 and 41; and said webs 39, 40 and 41 are joined to the top plate by respective welds 43, 44 and 45 which are formed in said elongate openings. There are no such openings in the bottom plate 32 so as to avoid transverse surface welds in said plate where they would be placed in tension by loads on the draw bar. The welds 43, 44 and 45 in the top plate are put only in compression by loads on the draw bar.

The box-like front part 22 of the carrying portion 21 of the circle draw bar consists of a bottom plate 46 and a top plate 47, together with side plates 48 and 49. The top plate 47 is fabricated of two sections 47*a* and 47*b* the adjacent edges of which overlap a longitudinal median web 50 and are joined to each other and to said web by a weld 51. The bottom and top walls 46 and 47 have forward extremities 52 which mate with the rear extremities 37 of the beam bottom and top walls 32 and 33; and forward plates 53 of the rearward carrying portion 21 are overlapped by the rear extremities 37 and the front extremities 52 so that said extremities and said plates may be joined together by a top weld 54 and a bottom weld 55 which are continuous with welds 56 that join the beam side wall 34 with the carrying portion side wall 48 and that join the beam side wall 35 with the carrying portion side wall 49.

As seen in FIGS. 3 and 7, the plates 53 extend along the forward extremity 52 of the bottom plate 46 and have bends 53*a* at the adjacent ends of the beam side walls 34 and 35 and the side walls 48 and 49, and said plates 53 have rearward portions 53*b* which extend along the inner surfaces of said side walls 48 and 49. Welds 53*c* and 53*d* join the plates 53 to the bottom plate 46 and to the web 50, respectively, so that they are a part of a subassembly consisting of the rearward carrying portion 21 of the circle draw bar 17.

The beam 20 has been described as a box-like structure with longitudinal and transverse internal webs. Structurally, it can also be regarded as an I-beam consisting of the members 32, 33 and 38, with the sides of the I-beam being closed by the side plates 34 and 35.

Referring again to FIG. 3, the ball 28 pivots around a center C. A line of dashes extending from said center C to the sidewall 34 at the line L—L represents one side T of an isosceles triangle the base of which is the line L—L. A dash dot line P from the point C to the side wall 34 in the vicinity of the transverse line L is a parabolic curve (one side of a parabola) from C to the intersection of L13 L with 34. It is seen that the side wall 34 falls between the line T and the line P. This is a significant structural feature in providing relatively equal distribution of stress throughout the length of the beam 20, whether that stress is due to vertical forces or transverse forces, or a combination of both, exerted on the beam. The ideal shape for producing equal distribution of stress due to vertical forces between the line L—L and the center C is a triangle one side of which follows the line T. Optimum equal distribution of stress due to lateral forces between the line L—L and the point C is achieved by a parabolic shape. Placing the beam side walls 34 and 35 between the line T and the line P compromises between optimum distribution of stress due to vertical forces and optimum distribution of stress due to lateral forces; thus providing a circle draw bar structure which is highly effective in distributing stress, due to either type of loading, along the length of the draw bar.

Fabricating the circle draw bar 17 in two parts which are later joined by welding greatly reduces the difficulties in forming the carrying portion 21 of the circle draw bar as compared with the problems that would exist if the draw bar were initially unitary. The cavities 23*a* must have sidewalls provided with openings for driving connections between the drive means 24 and the circle ring gear; and this and other parts of the carrying portion 21 require machining operations which could only be performed on large and expensive equipment if the circle draw bar were not initially fabricated in two parts which are welded together as a final assembly step. The shallow V conformity of the abutting margins 37 and 52 provides extended welds which do not, however, pass the transverse line L—L; and the flaring portion 36 of the beam 20 is structurally comparable to carrying the sidewalls 34 and 35 straight to the juncture with the margins 52, and then welding in top and bottom gussets. However, the resulting structure is much stronger and more rigid than it would be if made with gussets.

The foregoing detailed description is given for clearness of understanding only and no unnecessary limitations should be understood therefrom, as modifications will be obvious to those skilled in the art.

What is claimed is:

1. An improved motor grader circle mounting bar structure which has a connecting end provided with an integral ball which is adapted to be attached to a motor grader frame for universal movement about its own center, and which has a carrying portion adapted to be suspended from said frame by means which may pivot the mounting bar about said ball center, and said carrying portion being adapted to carry a circle structure for a grader blade, said improved mounting bar structure comprising, in combination:

a box-like beam the width of which increases from its connecting end toward said carrying portion, said beam having side plates, a top plate and a bottom plate both of which fill the entire space between the side plates from said connecting end to said carrying portion, and longitudinal and transverse internal vertical webs, the increase in width of said beam from its connecting end to the intersections of the side plates with a transverse plane which is near to but outside the circle being such that the side plates lie entirely between, a. an isosceles triangle plotted between the ball center and said intersections and b. a parabola plotted between said center and said intersections and a mounting bar carrying portion of box-like cross-section which is structurally integral with the wider end of said beam, said carrying portion having side plates which are extensions of the rear ends of the beam side plates, and having top and bottom plates integrally joined to said carrying portion side plates and integrally and continuously joined to the entire width of the beam top and bottom plates.

2. The improved structure of claim 1 in which the beam and the mounting bar carrying portion are separate elements which have abutting peripheral edges along which they are secured together by a weld.

3. The improved structure of claim 2 in which the abutting peripheral edges include top and bottom edges with lateral termini in a plane which is on a chord of the circle, and said top and bottom edges extend from said termini toward the connecting end of the beam and terminate adjacent a line on the longitudinal vertical median plane of the beam.

4. The improved structure of claim 3 in which said edges are straight between said termini and said line.

5. The improved structure of claim 1 in which the internal webs include a longitudinal web on the longitudinal median plane of the beam, and a plurality of transverse webs which are joined to said longitudinal web and to the sides of the beam.

6. The improved structure of claim 1 in which the increase in width of the beam is uniform between the connecting end of the beam and a transverse plane which is near to but outside the circle, and the beam increases in width more rapidly on the side of said transverse plane toward the circle.

7. The improved structure of claim 6 in which the beam and the mounting bar carrying portion are separate elements which have abutting peripheral edges along which they are secured together by a weld, said edges including top and bottom edges with lateral termini in a plane which is on a chord of the circle and extending from said termini to a vertical line close to said transverse plane.

8. The improved structure of claim 7 in which the internal webs include a longitudinal web on the longitudinal vertical median plane of the beam, and a plurality of vertical transverse webs which intersect said longitudinal web, the one of said tranverse webs which is nearest the circle extending diagonally from both sides of the longitudinal web in the direction of the mounting bar carrying portion, and being close to said transverse plane on the side toward the connecting end of the beam.

9. The improved structure of claim 8 which includes a longitudinal vertical web in the mounting bar carrying portion which is aligned with the longitudinal web in the beam.

10. The improved structure of claim 6 in which the shape of the beam in plan from its connecting end to the vicinity of said transverse plane is intermediate between a parabola with its apex at the transverse axis provided by the mounting means and an isosceles triangle with its apex at said transverse axis.

11. The improved structure of claim 1 in which the shape of the beam in plan from its connecting end to a transverse plane near the carrying portion is intermediate between a parabola with its apex at the transverse axis provided by the mounting means and an isosceles triangle with its apex at said transverse axis.

12. The improved structure of claim 1 which includes a wall between the beam and the mounting bar carrying portion.

13. An improved grader circle mounting bar structure which has a connecting end provided with an integral ball which is adapted to be attached to a motor grader frame for universal movement about its own center, and which has a carrying portion adapted to be suspended from said frame by means which may pivot the mounting bar about said ball center, and said carrying portion being adapted to carry a circle structure for a grader blade, said improved mounting bar structure comprising, in combination:

an I-beam having a vertical central web and identical top and bottom plates the widths of which increase from said connecting end toward said carrying portion, and side plates the longitudinal edges of which are secured to the top and bottom plates by welds, the increase in width of said beam from its connecting end to the intersections of the side plates with a transverse plane which is near to but outside the circle being such that the side plates lie entirely between, a. an isosceles triangle plotted between the ball center and said intersections and b. a parabola plotted between said center and said intersections and a mounting bar carrying portion of box-like cross-section which is structurally integral with the wider end of said beam, said carrying portion having side plates which are extensions of the rear ends of the beam side plates, and having top and bottom plates integrally joined to said carrying portion side plates and integrally and continuously joined to the entire width of the beam top and bottom plates.

14. The improved structure of claim 13 in which the beam and the mounting bar carrying portion are separate elements which have abutting peripheral edges along which they are secured together by a weld.

15. The improved structure of claim 14 in which the abutting peripheral edges include top and bottom edges with lateral termini in a plane which is on a chord of the circle, and said top and bottom edges extend from said termini toward the connecting end of the beam and terminate adjacent a line on the longitudinal vertical median plane of the beam.

16. The improved structure of claim 13 which includes a longitudinal vertical web in the mounting bar carrying portion which is aligned with the central web of the I-beam.

17. The improved structure of claim 13 which includes transverse internal webs secured to the central web, the top and bottom plates, and the side plates.

18. The improved structure of claim 13 in which the shape of the beam in plan from its connecting end to a transverse plane near the carrying portion is intermediate between a parabola with its apex at the transverse axis provided by the mounting means and an isosceles triangle with its apex at said transverse axis.

19. The improved structure of claim 1 in which the extreme rearward portion of the beam flares laterally outwardly in a gentle curve.

20. The improved structure of claim 13 in which the extreme rearward portion of the beam flares laterally outwardly in a gentle curve.

* * * * *